US008631612B2

(12) United States Patent
Duernberger

(10) Patent No.: US 8,631,612 B2
(45) Date of Patent: Jan. 21, 2014

(54) FACING PANEL

(75) Inventor: Gerhard Duernberger, Strasswalchen (AT)

(73) Assignee: Kaindl Flooring GmbH, Wals (AT)

( * ) Notice: Subject to any disclaimer, the term of this patent is extended or adjusted under 35 U.S.C. 154(b) by 3062 days.

(21) Appl. No.: 10/861,921

(22) Filed: Jun. 7, 2004

(65) Prior Publication Data

US 2005/0193672 A1 Sep. 8, 2005

(30) Foreign Application Priority Data

Jun. 5, 2003 (AT) ..... A 888/2003

(51) Int. Cl.
*E04B 1/00* (2006.01)
*E04F 15/04* (2006.01)

(52) U.S. Cl.
CPC ..... *E04F 15/048* (2013.01)
USPC ..... 52/105; 52/581

(58) Field of Classification Search
USPC ..... 52/578, 581, 105
See application file for complete search history.

(56) References Cited

U.S. PATENT DOCUMENTS

| | | | | |
|---|---|---|---|---|
| 4,035,967 | A * | 7/1977 | Harvey | 52/126.6 |
| 6,119,423 | A * | 9/2000 | Costantino | 52/390 |
| 2005/0193672 | A1 | 9/2005 | Duernberger | |

FOREIGN PATENT DOCUMENTS

| | | |
|---|---|---|
| EP | 0652341 | 5/1995 |
| EP | 1 484 195 S2 | 5/2004 |
| GB | 1593281 | 7/1981 |

OTHER PUBLICATIONS

Claims in English allowed by the European Patent Office, which claims Correspond to EP 1 484 195 A2 and US 2005/0193672 A1, pp. 6-8.
Preliminary Amendment filed in Appellant's appealed U.S. Appl. No. 10/861,921, filed Sep. 30, 2004.
A Statement of Accuracy of Translation by the translator of the Austrian Patent Application 888/2003 from German to English.

* cited by examiner

*Primary Examiner* — William Gilbert
(74) *Attorney, Agent, or Firm* — Millen, White, Zelano & Branigan, P.C.

(57) ABSTRACT

The present invention relates to a facing panel, on the long side surfaces of which there are connecting or locking elements (5, 6) that are different or which complement each other along the two parallel long side edges (4, 4') of the facing panel (1, 1') so that the long side edges (4, 4') of two facing panels (1) with different locking elements can be connected to one another. On the visible surface (7) of the facing panel (1, 1') there is a single stripe (2) that is parallel to and spaced apart from one of the two long side edges (4, 4'); the color of said stripe (2) is darker than the color of the remaining visible surface, one and the same connecting or locking element (6) being formed along the long-side edge (4) of the facing panel (1, 1') to which the stripe (2) runs parallel or to which it is close, one and the same connecting or locking element (6) being formed on the opposite long-side edge (4'), this being complementary to the connecting or locking element (5) or lockable thereto.

15 Claims, 1 Drawing Sheet

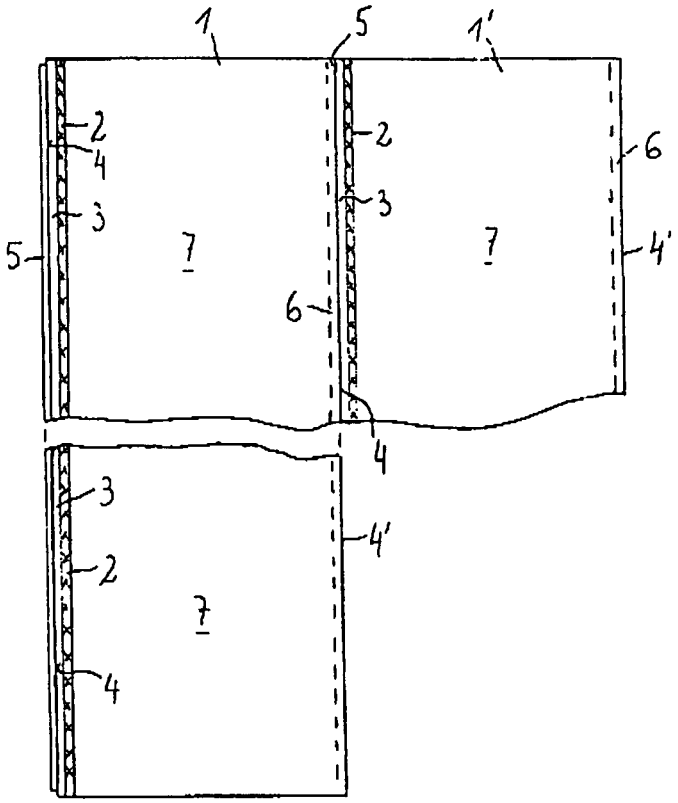
1
5
1'
2
4
3
5
7
2
3
6
7
4'
6
4
3
4'
2
7
4

FACING PANEL

FIELD OF THE INVENTION

The present invention relates to a facing panel for floors, walls, or ceilings.

RELATED ART

GB 1 593 281 describes thin, wallpaper-like decorative material with linear patterns, in the form of corner elements and straight strips that can be cut to length from a roll. In order to decorate the ceiling of a room, four corner elements are first cemented in place in the corners of the room and then four straight strips of the wallpaper material are if necessary cut to length from the roll and cemented into place. The straight strips are arranged along the edge between the ceiling and the wall, so that the lines form a continuous pattern.

SUMMARY OF THE INVENTION

The present invention simplifies the application of the facing panels or the combination of such facing panels to form a facing surface. These facing panels are simple to manufacture and inexpensive. In addition, a visually appealing appearance that will impress consumers is to be imparted to such a facing panel.

The technical effect is such that by creating a stripe on the visible surface of the facing panel, the unskilled user is provided with instruction and assistance for applying the material. This enables a layman to arrange the facing panels correctly relative to each other in the plane of application and then install them as required.

The process of installing the facing panels, particularly facing panels that are provided with connecting elements that function in combination with each other, has been made simpler by forming a dark stripe since, during the installation process, only one side edge without a stripe of this kind has to be joined to a side edge with such a stripe, so that costly inspection of the facing panels in order to ascertain which edge of a facing panel is to be joined to which edge of another facing panel is eliminated.

The stripe thus indicates the position of the connecting or locking elements, and the user can ascertain at first glance the side surfaces by which the individual facing panels can be joined, or how these panels are to be arranged. This means that work can be completed quicker and more efficiently.

In the usual course of events, the facing panels must be cut to size on site in order to conform to spatial conditions. In order that the panels can be cut to size, they must usually be moved from the location in which they are to be installed to the cutting site. When this is done, there is a danger that the facing panels will unintentionally be rotated, and then applied to the incorrect side. This can lead to difficulties during subsequent installation operations if, for example, a locking element that is provided on a long side is no longer available. This error is avoided by the configuration of the stripe, since the user can orient himself according to the position of the stripe.

In addition to the foregoing, when the panels are joined together, the dark stripe creates the impression that a depression has been formed between the assembled panels, or along the joint between them, or that a groove has been made in the surface that is flat in and of itself. This aesthetic and visual impression, which occurs in addition to the technical effect, is caused by the dark stripe that runs longitudinally and is created so as to be spaced apart from the joint line between the visible surfaces of two facing panels that have been joined together.

The connecting or locking elements, which have been selected in order to make it possible to join facing panels according to the present invention to one another, are formed along the periphery of the facing panel, in particular along the long side surfaces. These connecting elements can be of any form; such connecting or locking elements are familiar to the practitioner skilled in the art. These connecting elements are intended to hold the facing panels together along their long-side edges and optionally along their transverse side edges so as to achieve a strong connection between the facing panels.

The facing panels gain a particularly advantageous appearance, or the visual impression of a groove is enhanced by painting, pigmenting, inlaying, or the like.

It is appropriate if the basic material used for the facing panels be wood, wood material, medium density fibre board (MDF), high density fibre board (HDF), bonded wood chips, or fibre panel material.

It is an advantage if the top and/or underneath surface of the facing panel be provided with a natural wood or laminate coating or a plastic surface. The creation of the darker and/or lighter stripes can be managed as a function of the type of surface that is provided. In the case of a natural-wood base or natural-wood covering, the darker and the lighter stripes can be produced by appropriate surface removal or by colouring the surface of the wood. If a laminate covering is applied to the surface of the facing panel, this laminate covering could incorporate the stripes and then be bonded to the base body of the facing panel.

No darker or lighter stripes are formed along the transverse side edges, which is to say along the narrow sides, of the rectangular facing panels.

It is, of course, to be understood that the areas of the lighter and/or darker stripes are formed so as to be flat and flush with the remainder of the visible surface, so that they do not disrupt the even progression of the surface of the facing panels.

Advantageous configurations of the present invention are described in greater detail below on the basis of the drawing appended hereto.

DETAILED DESCRIPTION OF THE PREFERRED EMBODIMENTS

The drawing shows a diagrammatic plan view of a facing panel 1 that is joined to an adjacent facing panel 1' along a long-side edges 4, 4'. To this end, tongues 5 and grooves 6 are formed on the long-side edges of the facing panels 1, 1'; these tongues and grooves are matched on one another and function as locking elements that hold the facing panels 1, 1' together once they have been joined. The facing panels 1, 1' have a tongue 5 along their long side edge 4, and a groove 6 that accommodates the tongue 5 on the other long side edge 4'. A stripe 2 runs in the long direction along one of the two side edges 4 or 4' of each facing panel 1, 1'; the colour of this stripe 2 is darker than the colour of the remainder of the visible surface 7 of the facing panel 1, 1'. This darker stripe 2 imparts a particular appearance to the facing panel 1, 1'; it can also be used as an installation aid since facing panels 1, 1' have the same locking elements 5 [on the side that is opposite] the dark strip 2 that function in conjunction with the locking element 6 that runs parallel to the opposite long edge 4' that is remote from the dark stripe 2.

The area between the dark stripe 2 and the long side edge 4 can be of a lighter colour than the remainder of the visible surface 7 of the facing panel 1. This enhances the visual impression created by the darker stripe 2 even further.

The darker stripe 2 and/or the lighter stripe 3 can be created by various means. Mainly, these include the use of pigments or inlays, in particular during production of a laminate surface.

The colour of the visible surface 7 is unimportant, or it can be selected as desired; wood colours are selected in particular. The darker stripes and/or the lighter stripes 3 are preferably selected so as to maintain the coloration of the visible surface 7, or they can differ from this.

It is preferred that structures and/or grain patterns that are formed in the visible surface continue in the stripes 2 and/or the stripes 3, although they can be interrupted by the stripes 2 and/or stripes 3, which can be of another surface structure.

The defining edges of the stripe 2 are straight.

There is only a single stripe 2 on the visible surface 7 of a facing panel 1. The brightness of the stripe 3 amounts to 30 to 70%, preferably 40 to 60% of the brightness of the visible surface 7.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosure of all applications, patents and publications, cited herein and of corresponding Austrian application No. A 888/2003, filed Jun. 5, 2003 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

I claim:

1. A facing panel, in particular for floors, walls, or ceilings, the facing panel comprising: connecting or locking elements (5, 6) configured as tongues and grooves, being formed on long side surfaces of the facing panel (1, 1'), the connecting or locking elements being shaped along parallel long-side edges (4, 4') of the facing panel (1, 1') so as to be different or to complement one another whereby long-side edges (4, 4') formed with different locking elements can be joined, locked, or assembled to each other; orienting indicia consisting of a single visible stripe (2) on a visible surface (7) of the facing panel (1, 1'), extending parallel to and in close spaced relation to one of the two long side edges (4, 4') of the visible surface, the color of said stripe (2) being darker than the color of the remainder of the visible surface, one and the same connecting or locking element (6) being formed along the long-side edge (4) of the facing panel (1, 1') to which the stripe (2) extends parallel, and one and the same connecting or locking element (6) being formed on the opposite long-side edge (4'), this being complementary to a connecting or locking element (5) on an adjacent facing panel (1, 1') and lockable thereto.

2. The facing panel as defined in claim 1, wherein the area between the stripe (2) that is darker than the visible surface and the near side edge (4) of the visible surface (7) is lighter than the color of the remaining visible surface (7), or that between the darker stripe (2) and the side edge (4) a stripe (3) that is lighter than the visible surface is formed by one of painting, pigmenting, and inlaying.

3. The facing panel as defined in claim 1, wherein the width of the lighter stripe (3) amounts to 80 to 120% of the width of the darker stripe (2).

4. The facing panel as defined in claim 1, wherein the distance of the darker stripe (2) from the near side edge (4) is 80 to 120% of the width of the darker stripe (2).

5. The facing panel as defined in claim 1, wherein the darker stripe (2) and optionally the lighter stripe (3) extend to the whole length of the facing panel (1) or of the visible surface (7).

6. The facing panel as defined in claim 1, wherein the width of the darker stripe (2) or of the lighter stripe (3) amounts to 0.5 to 4% of the width of the facing panel (1) or of the visible surface (7).

7. The facing panel as defined in claim 1, wherein the area of the darker stripe (2) or of the lighter stripe (3) is formed so as to be or run flat and flush with the remaining visible surface (7).

8. The facing panel as defined in claim 1, wherein the material used for the facing panel (1, 1') is wood, wood material, medium density fibre board (MDF), high density fibre board (HDF), bonded wood chips or fibre panel material.

9. The facing panel as defined in claim 1, wherein the upper surface or the underneath surface of the facing panel (1, 1') is provided with a natural wood or laminate covering or with a plastic covering.

10. The facing panel as defined in claim 1, wherein the brightness of the stripe (2) amounts to 30 to 70% of the brightness of the visible surface (7).

11. The facing panel as defined in claim 1, wherein the width of the lighter stripe (3) amounts to 90 to 110% of the width of the darker stripe (2).

12. The facing panel as defined in claim 1, wherein the width of the darker stripe (2) or of the lighter stripe (3) amounts to 1 to 3% of the width of the facing panel (1) or of the visible surface (7).

13. The facing panel as defined in claim 1, wherein the brightness of the stripe (2) amounts to 40 to 60% of the brightness of the visible surface (7).

14. The facing panel as defined in claim 1, wherein the area of the darker stripe (2) and of the lighter stripe (3) is formed so as to be or run flat and flush with the remaining visible surface (7).

15. The facing panel as defined in claim 1, wherein the upper surface and the underneath surface of the facing panel (1, 1') is provided with a natural wood or laminate covering or with a plastic covering.

* * * * *